US011849886B2

(12) United States Patent
Strålin et al.

(10) Patent No.: US 11,849,886 B2
(45) Date of Patent: *Dec. 26, 2023

(54) LEVEL SENSOR AND DISPENSER

(71) Applicant: Essity Hygiene and Health Aktiebolag, Gothenburg (SE)

(72) Inventors: Anders Strålin, Torslanda (SE); Gunilla Himmelmann, Molnlycke (SE); Robert Kling, Skene (SE); Peter Rehnstrom, Falun (SE); Jerry Svedlund, Hedemora (SE)

(73) Assignee: ESSITY HYGIENE AND HEALTH AKITEBOLA, Gothenburg (SE)

( * ) Notice: Subject to any disclaimer, the term of this patent is extended or adjusted under 35 U.S.C. 154(b) by 303 days.

This patent is subject to a terminal disclaimer.

(21) Appl. No.: 17/199,512

(22) Filed: Mar. 12, 2021

(65) Prior Publication Data

US 2021/0244241 A1 Aug. 12, 2021

Related U.S. Application Data

(63) Continuation of application No. 13/823,307, filed as application No. PCT/EP2010/063543 on Sep. 15, 2010, now Pat. No. 10,973,377.

(51) Int. Cl.
*A47K 10/32* (2006.01)

(52) U.S. Cl.
CPC ..... *A47K 10/32* (2013.01); *A47K 2010/3226* (2013.01); *B65H 2557/11* (2013.01)

(58) Field of Classification Search
CPC ..... A47K 10/32; A47K 2010/3266; B65H 2557/11
See application file for complete search history.

(56) References Cited

U.S. PATENT DOCUMENTS 4,928,949 A * 5/1990 Ramsey ..... B65H 7/04 271/154
6,314,971 B1 * 11/2001 Schneider ..... A47K 10/32 134/44

(Continued)

FOREIGN PATENT DOCUMENTS

DE 20016735.9 U1 11/2000
WO 2006065515 A2 6/2006

(Continued)

OTHER PUBLICATIONS

International Preliminary Report on Patentability (PCT/IPEA/409) dated Jan. 3, 2013, by the European Patent Office as the International Searching Authority for International Application No. PCT/EP2010/063543.

(Continued)

*Primary Examiner* — Gene O Crawford
*Assistant Examiner* — Kelvin L Randall, Jr.
(74) *Attorney, Agent, or Firm* — BUCHANAN INGERSOLL & ROONEY PC

(57) ABSTRACT

A tissue dispenser, a method, system, and a sensor unit for detecting level of a consumable tissue product (201, 301) in a tissue dispenser (103, 106) located in a washroom. This includes provided a sensor unit utilizing two sensor elements (420, 430) each arranged to measure light reflected from a reflection field located on the tissue product, reflected directly from the tissue product, or measure the absence of the tissue product. Data from the sensor elements are wirelessly transmitted to a server (901) for further handling, such as for instance notification to a janitor in charge of service of the washroom.

21 Claims, 10 Drawing Sheets

(56) References Cited

U.S. PATENT DOCUMENTS

| | | | | |
|---|---|---|---|---|
| 7,549,814 | B1 * | 6/2009 | Arrington | B65H 26/08 400/613 |
| 2007/0236110 | A1 | 10/2007 | Kling | |
| 2010/0268381 | A1 * | 10/2010 | Goerg | A47K 10/3845 700/244 |
| 2016/0262580 | A1 * | 9/2016 | Fellhoelter | A47K 10/36 |

FOREIGN PATENT DOCUMENTS

| | | | |
|---|---|---|---|
| WO | 2006071148 | A1 | 7/2006 |
| WO | 2007067106 | A1 | 6/2007 |
| WO | 2007068270 | A1 | 6/2007 |

OTHER PUBLICATIONS

International Search Report (PCT/ISA/210) dated May 25, 2011, by the European Patent Office as the International Searching Authority for International Application No. PCT/EP2010/063543.
Written Opinion (PCT/ISA/237) dated May 25, 2011, by the European Patent Office as the International Searching Authority for International Application No. PCT/EP2010/063543.

* cited by examiner

LEVEL SENSOR AND DISPENSER

CROSS-REFERENCE TO RELATED APPLICATIONS

The present application is a continuation of U.S. Ser. No. 13/823,307, filed on Sep. 19, 2013, and which is a national stage application of PCT/EP10/63543, filed on Sep. 15, 2010. The entire contents of Ser. No. 13/823,307 and PCT/EP10/63543 are incorporated herein.

TECHNICAL FIELD

The present invention relates to a solution for detecting level of a consumable in a tissue dispenser.

BACKGROUND OF THE INVENTION

Some major concerns in washrooms frequented by guests in public or semi-public areas, e.g. company washrooms and so on are to continuously provide a clean environment and that all consumables are available for the guests. For instance making sure that toilet tissue, paper towels, and liquid soap are available is of great concern for the guests but this should be balanced with the cost of janitors visiting the washroom frequently.

Consumables are most often located in dedicated dispensers fixedly located in the washroom and the janitor checks the level of each consumable and refills the dispenser as necessary. When janitors change or refills material in the dispensers on regular service intervals material is often wasted since if there is a small amount still left in the dispenser the janitor changes anyway in order to make sure that the consumable does not run out before the next service occasion. One problem for the janitor is to know which dispensers that needs to be refilled or how much material to bring on a service round. There is therefore a need for solutions where it is possible to monitor the use and report to the janitor if the consumable is running out. Solutions have thus been developed that automatically dispense the consumable and that therefore can keep track of the use and estimate the level left. These dispensers automatically dispense the consumable upon sensing the presence of a guest in the vicinity or if triggered in any other way, for instance through a user interface on the dispenser. However, this type of solution can also lead to waste of material since the automatic dispensing provide a pre defined amount of consumable which is not an appropriate amount for each guest at each occasion. There is therefore a need for a more flexible solution. One such solution is shown in WO2006065515 which illustrates a dispenser with a sensor for detecting identification information of a product, to communicate this to a central unit, and arranged to vary a dispensing parameter, such as the amount to dispense.

Each dispenser is arranged to receive a certain type of consumable/product with a range of different qualities available. There is a need for providing a cost effective solution and energy effective system for determining levels of products in dispenser and at the same time being able to determine type of product with good readability and repeatability.

SUMMARY

It is therefore the object of the present invention to alleviate at least some of the problems mentioned for the known solutions.

This is provided in a number of aspects where a first is a tissue dispenser. The tissue dispenser comprises a tissue holder arranged to receive a tissue product to be dispensed from the tissue dispenser and at least one detection device arranged on the tissue holder. The detection device comprises at least one processing unit, at least one communication interface, and at least two sensor elements each comprising a light source and a light detector and the two sensor elements being separated a distance from each other in at least one direction relative the tissue product. The detection device is arranged to transmit light from the light source and detect reflected light in the light detector and wherein the processing unit is arranged to obtain signals from the reflected light from the two sensor elements in relation to each other such that the level of tissue in the tissue holder can be determined and to communicate the obtained signals to a central server using the communication interface.

The dispenser arranged accordingly provides an accurate, reproducible, and flexible way of determining the level of the tissue product in the dispenser.

The processing unit may be arranged to detect a difference signal from the sensor elements, e.g. due to a different reflectivity from each reflectivity level of an area of the tissue or to different reflectivity of reflection fields located on the tissue product. This increases the reproducibility of the detection and may be used for determining the level of tissue product. The level may be determined in steps, e.g. in at least three levels related to need for providing refill: e.g. refill not needed, refill soon to be needed, refill is needed, or furthermore refill changed for another position. This type of level identification translates easily to the purpose of the level detection and provides a quick understanding of what need to be done by the janitor.

The light detector may comprise a photo detector or a light emitting diode (LED) operating in reverse mode. The use of a LED reduces cost for the optical components drastically.

The tissue dispenser may further comprise tissue refill and which refill have a reflectivity level of an area of the tissue or is provided with a reflective field located on the tissue product so as to provide a reflection reference with known reflectivity.

The communication from the tissue dispenser to the server is advantageously provided as wireless communication directly to the server or via a data collection unit. The data collection unit may be located in a washroom and collect data from a plurality of tissue dispensers. The light transmitter and detector may be provided as separate units or in the same unit. In one embodiment the detection unit only measures the signals from the sensor elements and relay this to the server but it should be appreciated that level determination may be provided in the detection unit or in the data collection unit.

The sensor elements are arranged to measure light reflected from the tissue product or the absence of reflected light due to the absence of tissue product. The tissue product may be provided with reflection fields on a side of the tissue product located towards the sensor elements. These reflection fields may be provided using different techniques as will be discussed in the detailed description and depending on these reflection fields, the absence of reflection field, and/or absence of tissue product different signal levels will be obtained by the sensor elements. The sensor elements may be provided using different types of components, combination of components, and optimized depending on type of tissue product to monitor level of. The signals may be communicated with any suitable type of wireless communications technology as will be discussed in the detailed description.

The determined level may be used for determining a cause of action, for instance when the level is getting below a certain level information about this may be transmitted from the server to for instance a janitor in charge of servicing the washroom that refill is needed on the next service round or if the level is below a threshold that refill is needed immediately and the janitor may make an extra service round to the washroom. In this manner the user frequenting the washroom may experience a better environment and reduce the risk for inconvenience of running out of tissue products during the visit.

The tissue product may have a reflectivity level of an area of the tissue, which for instance may be provided by the tissue product itself or through one or several reflection fields located on the tissue product. This will provide flexibility in providing capability of identifying a quality of the tissue product and/or increase the measurement signal, for instance by providing a difference signal between the two sensor elements. The reflectivity level of an area of the tissue product may be provided as a reflection reference and a signal related to the reflectivity may provide at least information about the identity of the product, the level, or the quality of the tissue product. The use of known reflectivity or reflection level may provide information about e.g. level of tissue product, type of tissue product, and/or quality of tissue product. The use of reflection references or at least one or a plurality of reflection fields is advantageous since it is possible to provide further information about the tissue product as indicated above and also provide a further resolution in detecting the current level.

Optical transmitters may be any suitable type generating light in the ultraviolet, infrared, or visible range, such as a lamp, laser, or light emitting diode (LED), and the optical detectors may also be any suitable type for detecting light, such as a photo detector or light emitting diode operating in reverse mode. LED's are cost effective and using them both as transmitters and detectors may provide a flexible and cost effective solution for this type of application which benefits from low cost and high volume components.

The present invention is also provided in a second aspect in the form of a method for detecting level of washroom tissue products and for handling washroom maintenance using the tissue dispenser of the first aspect. In the method one may also be provided with information about consumption by detecting a movement of a tissue refill. The detection device comprises at least two sensor elements and a movement is identified in a direction from a first sensor element to a second sensor element where a level is determined from a difference signal which in turn is determined by obtaining a first and a second sensor signal from the reflected light from each first and second sensor element respectively.

Furthermore, the present invention is realized in a third aspect: a system for handling refill of washroom tissue products using the tissue dispenser and a server. Optionally the system may also comprise a data collection unit collecting data from a plurality of tissue dispensers. The system may also be arranged to detect at least three different types of qualities of tissue product. The system may be arranged to utilize reflectivity level of an area or reflection fields, or the absence of reflection fields for determining the level of tissue product. The system provides a solution for alerting service personnel about the current status of tissue products levels.

Still another aspect of the present invention is provided, a sensor unit for detecting a level of a tissue product in a tissue holder. The sensor unit may comprise two sensor elements each comprising a light source and a light detector. The sensor elements may be separated from each other in at least one direction relative the tissue product. The sensor unit is arranged to detect at least one of reflected light from the light source and wherein the reflection is provided from at least one of a reflective field located at least on a part of a side of the tissue, an area without a reflective field, and the absence of tissue product and wherein the sensor unit is arranged to provide a difference signal from the two sensor elements comprising information relative the level of the tissue product.

Yet another aspect of the present invention is provided, a washroom tissue refill product arranged with at least one reflective field located on at least one side of the tissue refill product, for use together with a tissue dispenser according to the first aspect of the present invention. The reflective fields may comprise information about identity of the product. The identity of the product may be provided utilizing at least one of reflectivity of the reflective field and location of a plurality of reflective fields. The sensor unit is may be provided as a separate unit easily installed in dispenser providing a solution where the sensor unit may be retrofitted in dispenser and/or where it may be fitted with small amount of alterations of the dispensers.

LEDs are energy effective and have a long life time and thus provide a cost and energy efficient solution in this type of solution. Since the detection device may be battery operated it is also energy efficient and easy to install at different locations of interest.

DETAILED DESCRIPTION OF PREFERRED EMBODIMENTS

Figure 1:
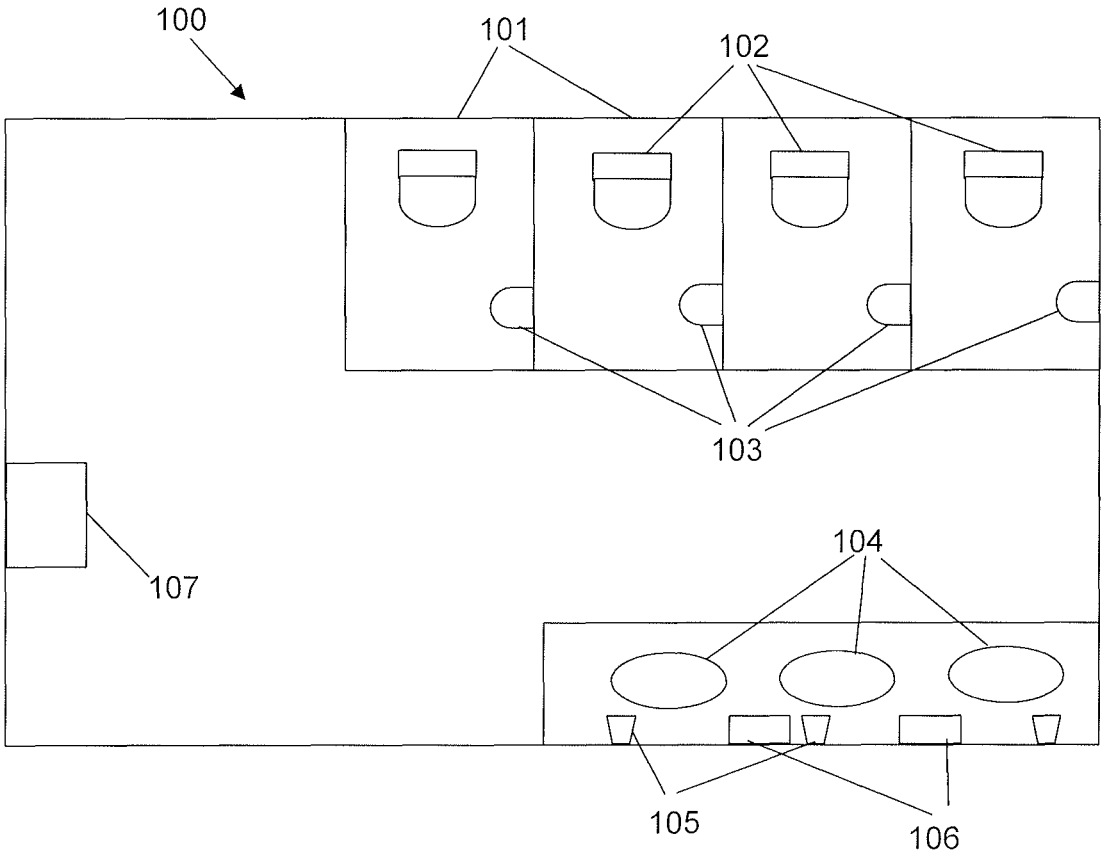
FIG. 1 is a schematic block diagram of a local system according to the present invention.

In FIG. 1, reference number 100 generally indicates a washroom comprising a number of toilet stalls 101 with toilet seats 102 and toilet tissue dispensers 103. Furthermore, a cleaning area is provided with a number of sinks 104 and equipped with soap dispensers 105 and towel tissue dispensers 106. The washroom may also be provided with a data collection unit (DCU) 107. Each dispenser may be arranged with a detection device, for instance a sensor control unit (SCU), for determining a level of each dispensing product and a communication interface for communicating the level to the DCU or to a central server (not shown) for further handling.

The tissue dispensers may be one of two different types: dispensers providing a web of sheet material from a continuous roll of absorbent material and may be periodically perforated for separation or cut by the dispenser or dispensers providing pre cut tissue sheets stacked in a pile. For instance the former type is often used in toilet tissue dispensers and the latter in towel tissue dispensers providing paper for wiping hands after washing.

Figure 2:
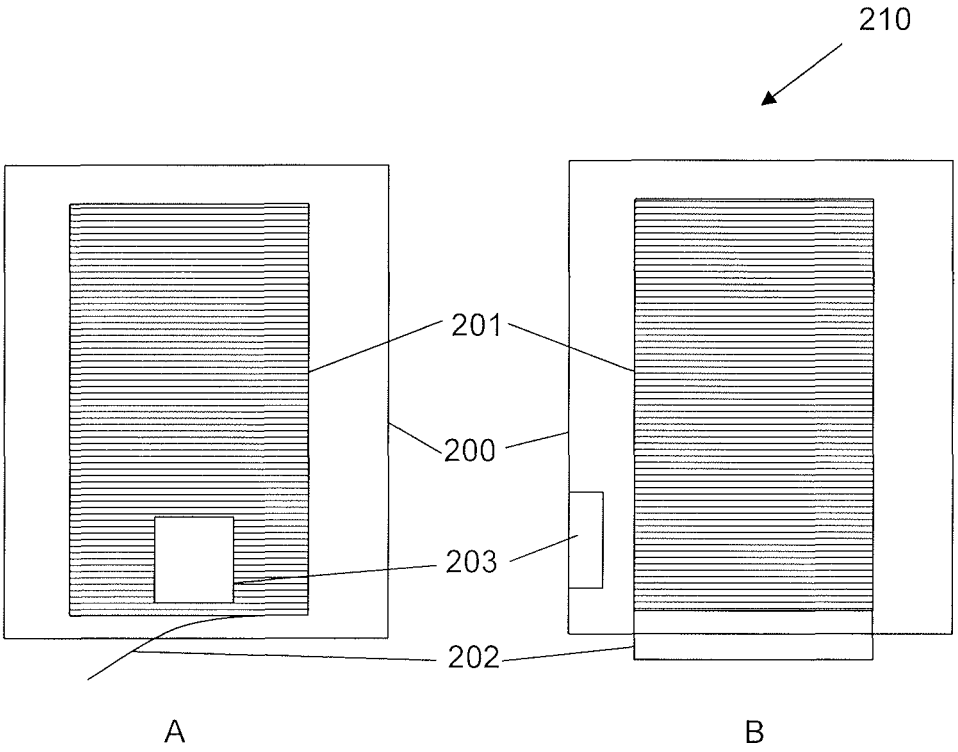
FIG. 2A and B are a schematic illustration in two different angles of a dispenser according to the present invention.

In FIG. 2 a dispenser 210 providing a sheet material stacked in a pile 201 inside a tissue dispenser holder 200 is illustrated together with a sensor control unit 203 (SCU). In FIG. 2 a dispensing sheet 202 is shown. The SCU is arranged to detect the level of the sheet material and may also be arranged to detect the type of material, e.g. the quality of the material.

Figure 3:
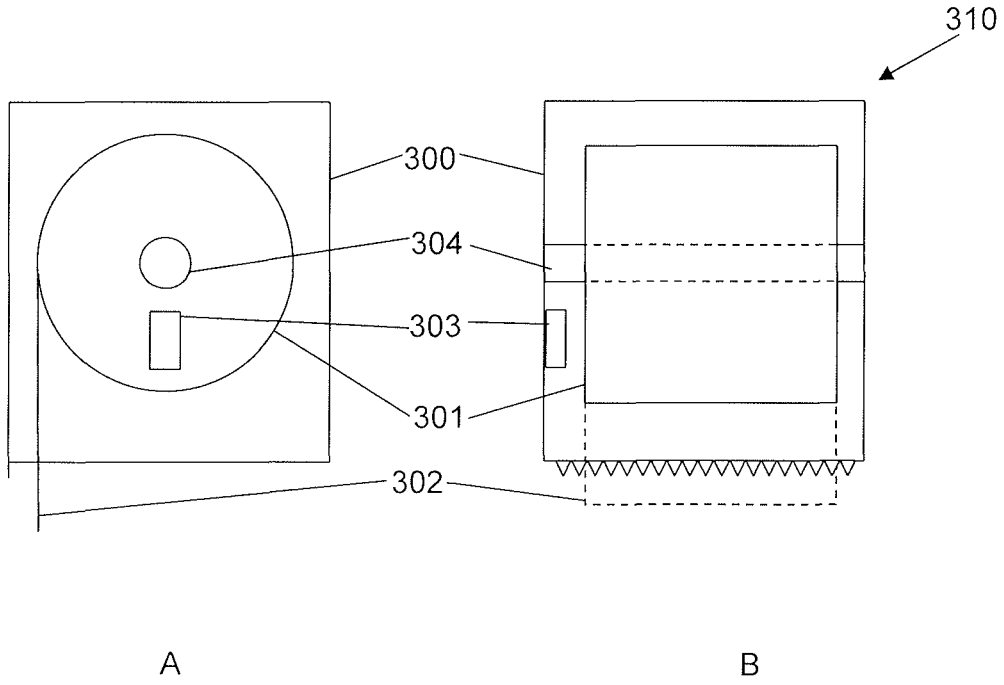
FIG. 3A and B are a schematic illustration in two different angles of another dispenser according to the present invention.

In FIG. 3 a dispenser 310 providing a web of continuous material in a roll 301 in a tissue dispenser holder 300 is shown. Also in this embodiment a sensor control unit 303 (SCU) is provided for determining the level of the material and optionally the type/quality of the material. The roll may be arranged with a channel for accommodating a rotation axis 304 for loading in the dispenser or the roll may be attached to the dispenser in any other suitable way allowing for rotation of the roll as the material is dispensed.

Figure 4:
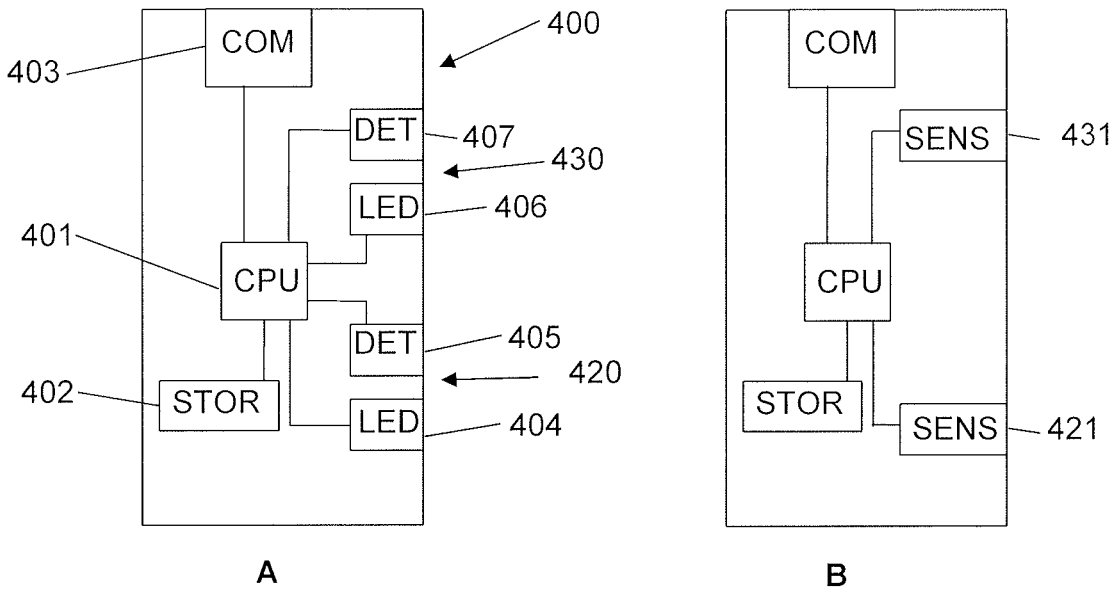
FIG. 4A and B is a schematic block diagram of a sensor collection unit according to two embodiments of the present invention.
FIG. 4C is a schematic block diagram of a data collection unit according to the present invention.

An exemplary sensor collection unit (SCU) 400 is shown in FIG. 4A, comprising at least one processing unit 401 (CPU), at least one storage unit 402 (STOR), such as a memory unit, at least one communication unit 403 (COM), and at least one sensor element 420 and 430. Each sensor element may comprise a light transmitter 404 and 406, e.g. a LED, laser, or lamp, and a light detector, e.g. a LED or a photo detector 405 and 407. Each sensor elements may alternatively comprise both a light transmitter and a light detector in the same sensor unit, e.g. using a LED; this may be seen in FIG. 4B with sensor units 421 and 431 each comprising a combined light transmitter and light detector; i.e. the same unit operates both as light transmitter and light detector for instance in a switching manner or incorporated into the same component. The two sensor elements 420 and 430 are separated a distance from each other preferably in a direction relative the general movement of the tissue when dispensed; however, as will be shown later this is not always the case.

The light transmitter 404, 406 transmits light on to the tissue product, the light is reflected or is dissipated if no tissue product is available; thereafter the reflected light is detected by the detector 405, 407 or the LED detects the absence of tissue product. The LED detector may be a normal LED, e.g. similar to the LED transmitter, operating in "reverse" mode, i.e. when light is directed on to the LED a small current will be produced and this may be detected using appropriate amplification and filtering electronics. The light transmitted from the transmitter may be of any suitable wavelength including, but not limited to, visible, ultraviolet, or infrared wavelengths. It should be noted that the light transmitter and light detector may be separate components or they may be mounted in the same casing and provided as a single component.

Figure 4C:
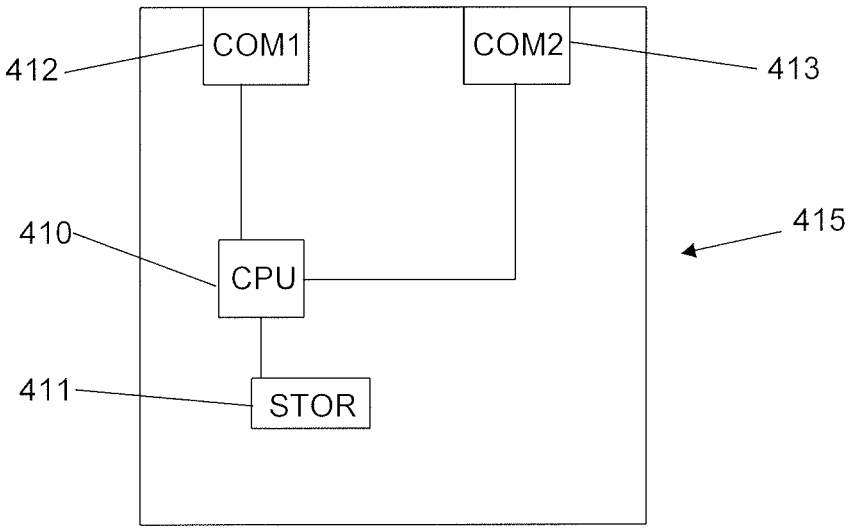

The components of the SCU are mounted on a circuit board and appropriately mounted in a casing with light transmitter/detector openings. The SCU may further comprise a power supply, e.g. a battery, light transmitter/detector electronics, e.g. amplification circuitry, drive circuitry, filter circuitry, power supply control circuitry, and circuitry connecting the different functional elements together. The processing unit may comprise any suitable type of unit executing instructions sets of software or hardware program; the processing unit may for instance be a central processing unit (CPU), a microprocessor, a micro controller, a field programmable gate array (FPGA), or an application specific integrated circuit (ASIC). The memory unit may be arranged to hold instructions sets for operating the SCU, calibration data and other similar data, and measurement data from the at least one sensor. The processing device is also arranged to communicate with at least one external device, such as for instance a data collection unit (DCU). The memory unit may comprise at least one of a volatile and/or non-volatile memory type memory, for instance at least one of a read only memory, random access memory (RAM), electrical erasable programmable memory (EEPROM), flash memory, hard disk, and so on. The communication unit may be arrange to use any suitable short range communication method, for instance using publicly available unlicensed ISM band (industrial, scientific and medical), e.g. Bluetooth, Wireless local area network (WLAN) according to any suitable standard such as 802.11 standard series, or proprietary communication protocols. It should be appreciated that also long range communication protocols may be used, for instance GSM, GPRS, EDGE, UMTS, LTE, WCDMA, CDMA2000, and so on. It should be noted that ISM bands may operate at several different approximate center frequencies such as 6.78 MHz, 13.56 MHz, 27.12 MHz, 40.68 MHz, 433.92 MHz, 916 MHz, 2.45 GHz, 5.8 GHz, 24.125 GHz, 61.25 GHz, 122.5 GHz, and 245 GHz. For instance, a short range device (SRD) uses advantageously a low power radio communication solution operating at any suitable unlicensed wireless communication radio. The frequency interval for the sensing or the radio communication may be changed according to different demands, for instance depending on type of dispenser or battery consumption demands. The sensing intervals as well as the radio communication intervals might e.g. be in intervals of 1 per second, 1 per 10 seconds, 1 per minute, 1 per minutes, every 480 seconds, 1 per 10 minutes, 1 per hour, 1 per day or any suitable time interval there between or longer or shorter The data collection unit (DCU) 415 comprises, as seen in FIG. 4C, at least one processing unit 410, at least one memory unit 411, at least one SCU communication unit 412, and at least one long range communication unit 413. The processing unit is arranged to execute instruction sets for operating the DCU as to collect data from the SCU(s) and relay these data to a central server as will be discussed in more detail with reference to FIG. 9. The DCU receives data from the SCU(s) using the DCU communication unit operating with the same communication protocol as the communication interface at the SCU(s). Communication may also be received directly by a central server from the SCU; in this case each SCU or a sub set of SCU's has long range communication interfaces and may transmit data directly to the server. In case of a sub set of SCU comprises long range communication interfaces, these SCU's also may comprise a short range communication interface in order to communicate with SCU's only comprising short range communication interfaces. This may be seen as an ad-hoc network solution where the SCU's together form a network with each other and some SCU's may relay data to the server or directly to a device operated by the janitor or similar person in charge of maintaining the washroom. It should be appreciated that the SCU communication unit may operate with several different radio protocols, for instance by having a plurality of radio communication units and/or using a software-defined radio unit. This enables the deployment of SCU(s) at different occasions and upgrading of SCU(s) when new technology becomes available or if an SCU is broken and need to be replaced. The processing unit of the DCU relays the data via the long range communication interface and via a communication network to the server. The long range communication unit may operate with any suitable type of communication mode/protocol, e.g. GSM, GPRS, EDGE, UMTS, HSDPA, LTE, WCDMA, CDMA2000, and so on as understood by the skilled person and the communication network may be an infrastructure network for the above mentioned communication protocols and/or a packet based communication network such as the Internet or an intranet.

It should be noted that even though the present invention has been exemplified with wireless communication between the SCU and DCU and the DCU and the server, alternatively wired connection may be utilized at either connection, e.g. using Ethernet standard. Furthermore, non radio based wireless communication protocols may be used between the SCU and DCU, e.g. infrared communication technology. Furthermore, alternatively, the SCU may communicate directly with the server or with equipment operated by the janitor using a long range wireless communication mode.

The level detector advantageously comprises two separate elements each with a transmitter and detector as discussed earlier. The two elements are separated a distance from each other relative the dispensed product in order to get readings on different parts of the dispensed product. This two elements feature may be useful for increasing the readability of the level detector. The tissue material may be arranged with a reflective field on a side of the refill, which reflective field may be used for reflecting the light from the transmitter and optionally providing a reference of known reflectivity. This reflective field may for instance be applied on only part of the tissue product side as will be discussed later below. However, it should be noted that the two separate elements may be arranged so as to detect different types of reflectivity of the tissue refill, for instance such as one sensor unit detects light reflected from a portion of the refill with a reflective field and the other sensor unit detects light reflected from a portion of the refill without a reflective field—thus signals from the two sensor units will be different and a difference signal may be provided increasing the signal to noise ratio and thus the readability of the level. By varying the reflectivity level of an area of the tissue product or the reflective field it is possible to provide identification of different types of material or different qualities of material. The sensor elements are arranged to detect different contrast values since the transmission light output may be calibrated and may therefore be considered known. Using fields with different reflectivity contrast, e.g. with different colors or grey scales, fields with density gradients, or different intensities, e.g. different intensities of colors, it is possible to provide information about the level, quality, type, and/or brand of the product—the solution may determine a measure of reflectivity level. The reflective field may be made of different dyes of different color, different intensities, a fluorescent material, a phosphorescent material, or different textures creating differences in reflectivity as compared to surrounding areas of the product. The fields may be printed or mechanically provided on the product. The reflectivity level of an area of the tissue may also refer to reflective properties of the tissue paper as well as a reflection field provided on the tissue paper. The reflectivity level of an area of the tissue provides a reflection reference which could provide info about the type of tissue product, quality of tissue product, etc. The reflection reference can also give information about the location on the tissue refill and can refer to the reflective properties of the tissue paper or reflective fields. It should thus be noted that the use of reflective fields is not necessary, but that reflection of the light may be provided directly on the material of the product; however, at the expense of possibly making it more difficult to detect the quality or type of the material. If the quality is to be determined without reflective fields, the sensor unit needs to determine the reflectivity level with higher accuracy and determine the quality from this measurement. The sensor elements are arranged to detect any area capable of reflecting light and/or the absence of tissue product. Use of UV transmitters/detectors may for instance be used to discriminate between virgin or recycled paper since they comprise different levels of whiteners that behave differently in UV light.

The placement of the sensor elements in the dispenser may be varied depending on the type of dispenser, dispenser height, and/or tissue product. For instance the sensor elements may be provided on a rail and may be repositioned and fastened on the rail if so needed.

As for large dispensers, they can be refilled as soon as there is space enough in the dispenser; a problem in such a situation may be that consumption might not be correctly monitored with only one SCU/detection device since it is placed somewhere close to a dispensing outlet, such that the last refill is detected by the SCU unit. In such cases more detection units, i.e. SCU(s) may be required in order to get a relevant level indication.

The sensor elements may comprise different types of light detectors, e.g. LEDs operating in different wavelength areas. One detector may operate in the UV area and the other in the visible or infrared area. Furthermore, the detectors may be of different quality providing different signals depending on the reflectivity level or reflective fields. The use of different types of detectors and/or transmitters may also be used for providing detection of quality of tissue product. The signal strength from the detector will vary depending on light provided and quality of tissue product, for instance reflective properties of recycled tissue paper will depend on recycled content and thus vary from different production batches whereas reflective properties in the visible regime will depend on paper brightness. This may be seen in table 1 below indicting reflectivity for different types of paper and detectors:

TABLE 1

| | Recycled | Hybrid | Virgin |
|---|---|---|---|
| UV detector (recycled content) | High | Medium | Low |
| LED detector (paper brightness) | Low | Medium | High |

With the term recycled in table 1 is meant a paper comprising a high content of recycled paper, with the term virgin with a low content of recycled paper, and the term hybrid paper comprising both recycled and virgin paper.

The same differences may also be found when using different types of coloring of the transmitter and depending on type of light detector each color will give different responses in the light detector. Table 2 indicates differences in detector response as a function of color:

TABLE 2

| | Blue | Yellow-Green | Red |
|---|---|---|---|
| Detector range 450-500 nm | High | Medium | Low |
| Detector range 640-700 nm | Low | Medium | High |

The detector range number indicates a wavelength range where the detector is optimized and is given in nanometers.

One may also combine different types of transmitters and detectors, for instance using a UV LED transmitter together with a RED LED 640 operating in reverse mode may give a good possibility to separate different qualities of paper. Recycled paper may give a low signal in the detector with ordinary LED sensors due to low brightness, whereas the UV sensor would yield a high signal due to high content of fluorescent material in the paper. In virgin qualities the opposite is true, where a LED 640 sensor will yield high signal strength due to the better reflection of the bright paper—the UV sensor yields low signal levels due to the low content of fluorescent material in the virgin paper. Combining the different types of transmitters and detectors may provide suitable separation of different qualities. It should be noted that the two sensor elements may also comprise different combinations.

Figure 5:
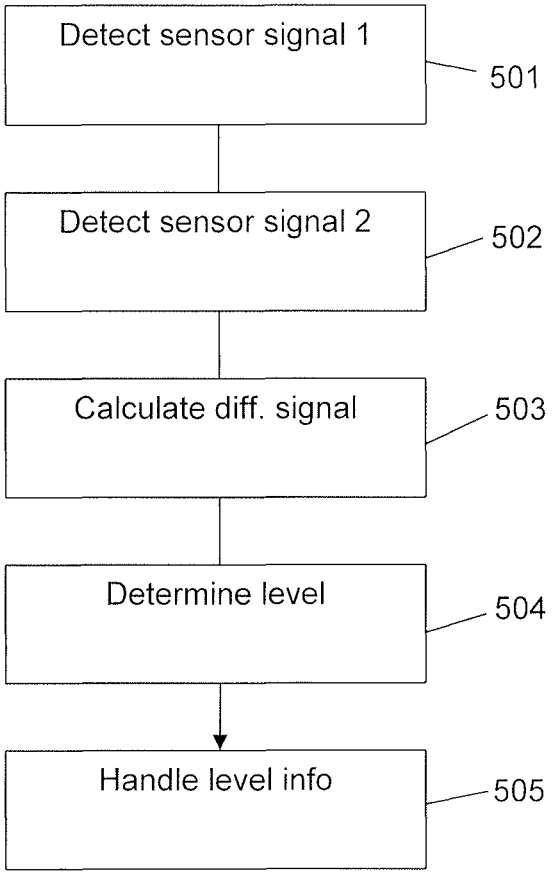
FIG. 5 is a schematic illustration of a general method according to the present invention.

FIG. 5 illustrates a method according to the present invention that utilizes a difference signal measurement solution. Periodically, the SCU reads data from each sensor element. The SCU takes a reading from a first sensor element and thereafter takes a reading from a second sensor element, step 501 and 502 respectively. The sensor data is analyzed 503 for determining a difference signal. From the difference signal the current level may be determined 504 of the dispenser refill. Depending on the current level different action may be taken and handled. It should be noted that the analysis and level determination may be executed in the SCU, the DCU, the server, or in a combination of these, e.g. analysis of data in SCU or DCU and level determination in server. It should be noted that the level may be determined with high resolution, such as a percentage of the full refill, or within pre defined levels, e.g. no refill needed, refill needed shortly, refill needed immediately, or changed to another position, such as e.g. a stub roll position, or similarly broadly defined levels. Furthermore, the solution may be arranged to determine consumption of consumable rather than a certain level, e.g. determining when a stack of tissue product refill has been depleted and thus at least one stack of tissue product may be inserted into the dispenser.

Figure 6:
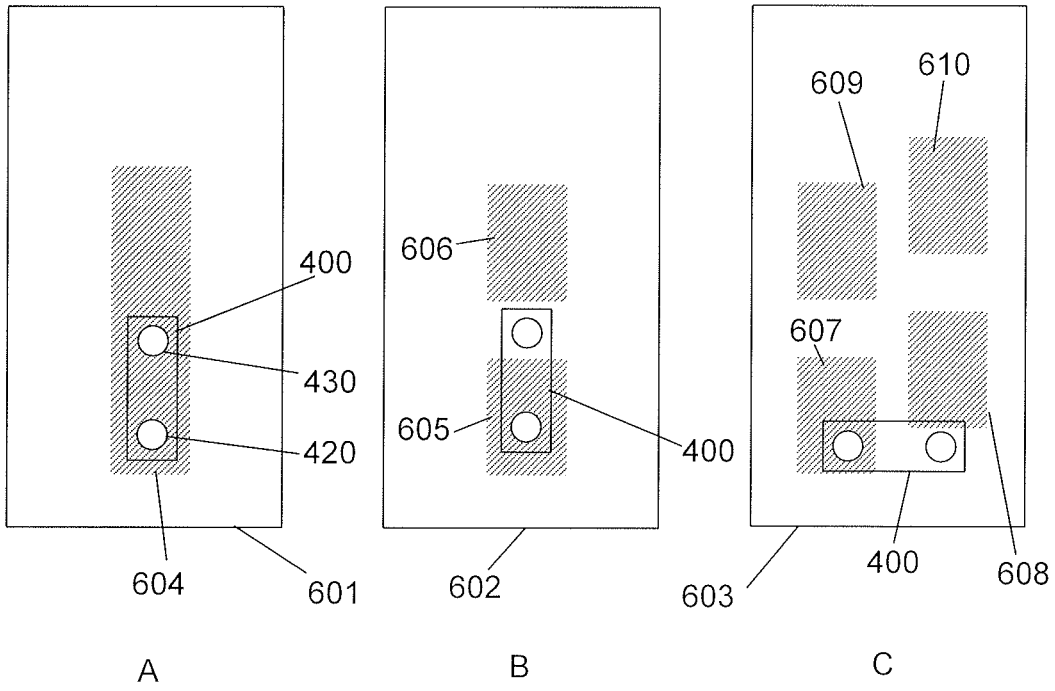
FIG. 6 is a schematic illustration of a refill configuration according to an embodiment according to the present invention.

FIG. 6 illustrates some examples of reflective fields on a tissue stack. FIG. 6A shows an example with a single reflective field 604 on the stack 601. SCU 400 has two sensor elements 420 and 430 reading data from the stack and depending on the level of the stack different signals will be obtained; this will be discussed in more detail further below.

FIG. 6B shows an example where the reflective field on the stack 602 is divided into several separate fields 605 and 606. Depending on how the reflective fields are located in respect to the sensor elements 420, 430 different signals will be obtained that can increase information about level and/or type of material in stack.

FIG. 6C shows still another example where the reflective fields on the stack is further divided which provides the possibility to increase the number of types/qualities of products that may be identifiable by the system. In FIG. 6C four different reflective fields have been illustrated, but it should be appreciated that the invention is not limited to these alternatives.

Figure 7:
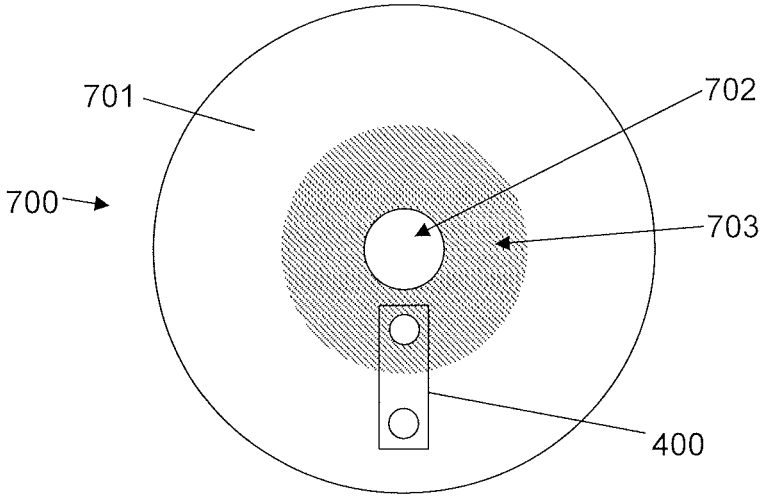
FIG. 7 is a schematic illustration of a refill configuration according to another embodiment according to the present invention.

In applications with a continuous roll of web material another variation of reflective field may be used as can be seen in FIG. 7. The roll 700 may have an optional channel 702 through the roll for easy loading in a dispenser and has a reflective field 703 on a flat side 701 of the roll. The SCU 400 with its sensors detects the level of the product using the reflective fields as discussed earlier for instance in relation to FIG. 6; also in this application a plurality of fields of reflection may be used.

Figure 8:
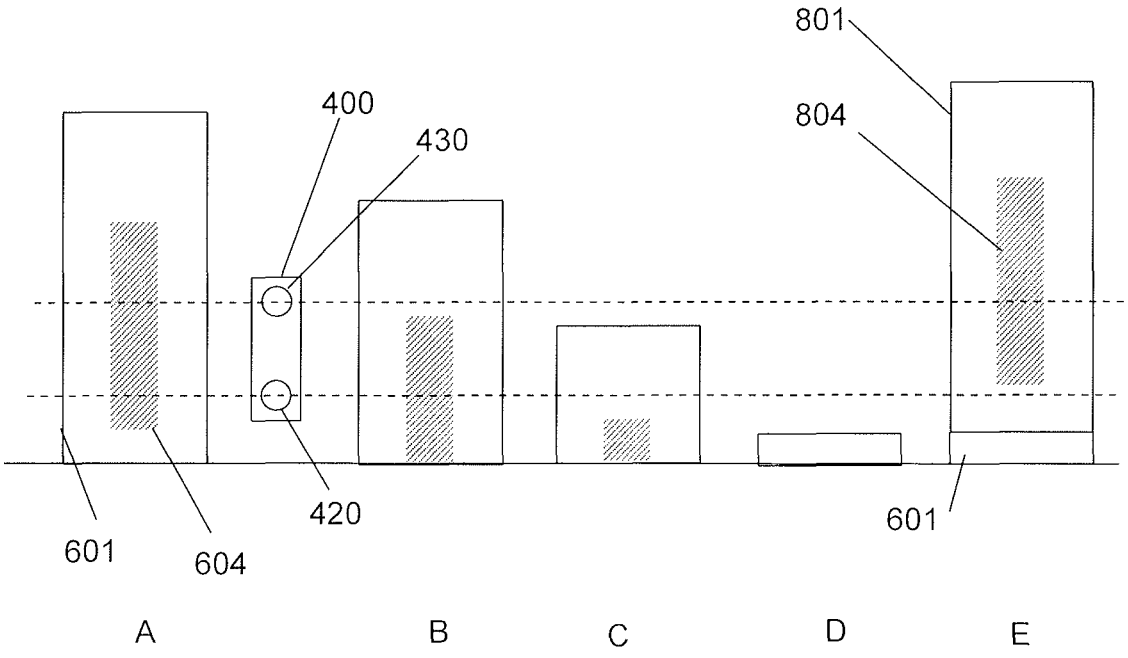
FIG. 8A to E is a schematic illustration of an operation of the solution according to the present invention.
Figure 9:
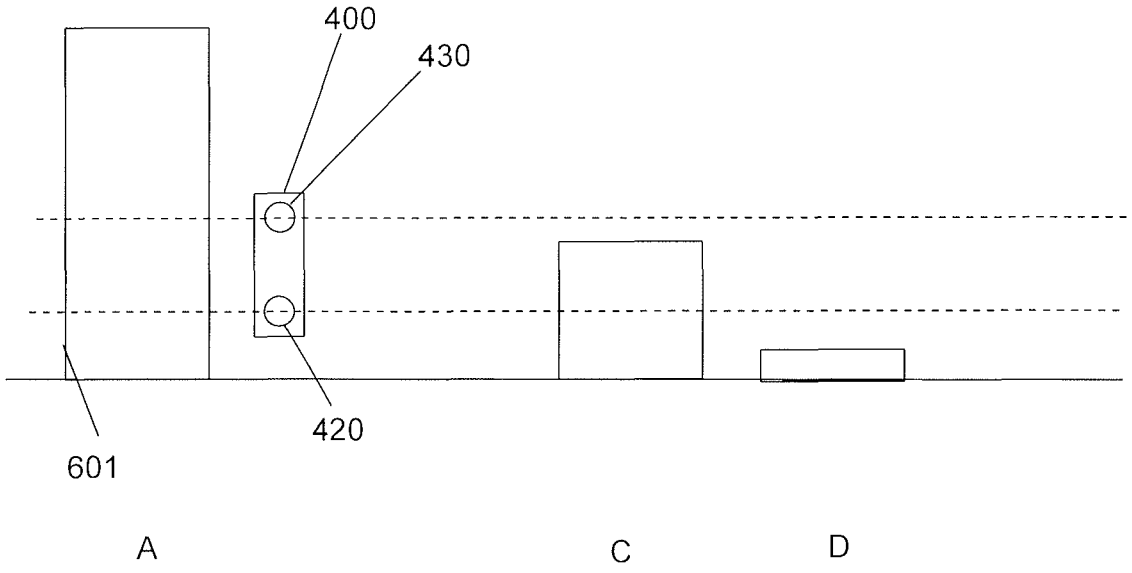
FIG. 9A, C, D is a schematic illustration of an operation of the solution according to the present invention.

FIG. 8 illustrates an example of how a reading of a reflectivity level of an area of the tissue may be changed during dispensing of the product. Further, FIG. 9 illustrates a variant of the solution as shown in FIG. 8, wherein reflective fields are not used but only the reflectivity of the tissue product 601 itself is used, i.e. a reflectivity level of an area of the tissue product provide information about the level. During the first step A both sensor elements 420 and 430 of the SCU 400 detect the presence of tissue product 601, i.e. there is no indication that the level of the tissue product is too low. In the next step C, one sensor element 420 detects the presence of tissue product whereas the other sensor element 430 does not detect the presence of tissue product, i.e. the tissue product is starting to get too low and a replacement is needed within a short time. Finally, in step D none of the sensor elements detect any tissue product, i.e. a signal may be triggered that the tissue product is very low or has been depleted and refill is needed immediately. In FIG. 8 a stack of tissue is shown, but it should be appreciated that the same process may be applicable to a continuous web of tissue in a roll. In the first stage (A) the stack is full and each of the sensor elements 420 and 430 of the SCU 400 detect a reflective field. As the stack height decreases due to the dispensing of the product the tissue refill and the reflectivity level of an area of the tissue, and in FIG. 8 the reflection field moves further down as seen from the perspective of the sensor elements and in stage B the reflective field is now in a position where the lowest element 420 detects a reflective field but not the highest sensor element 430—this may provide some information about the current level of the stack. In a further step C the lowest sensor element does not detect a reflective field as in FIG. 8 but still detects the stack whereas the highest sensor element 430 does not detect either the reflection field or the stack—this may trigger a first reaction, for instance triggering the SCU to send a first signal to the DCU or server informing that the stack is getting lower and that refill may be needed some time soon; for instance notification to the janitor to include this dispenser in the coming service round. The server may transmit information to a device operated by the janitor, e.g. in a simple form as a text message to a mobile phone or smart phone; however, it should be noted that special software to be executed in the device of the janitor may be developed for more complex handling of refill and service interval operations; for instance graphical display of each washroom and which dispensers that needs to be refilled and so on. In step D the stack is so low that none of the sensor elements 420 or 430 detects a reflection field or the stack and this may trigger a second reaction, for instance sending a second signal to the DCU informing that the stack is of immediate risk of depletion and that refill of the dispenser should be done. It should be noted that also the second stage B may trigger a reaction for informing about the current level situation. In some dispenser solution several piles of tissue may be stacked on top of each other, which, relating to FIG. 8, may be understood from step E where a second stack 801 with its reflection field 804 is stacked on top of the old stack 601; in this example the lowest sensor element will detect a stack but no reflection field and the highest sensor element will detect a reflection field—which may be interpreted by the SCU, DCU or server as there being another stack on top of the other and there is thus no immediate need for refill.

The analysis of the current product level, and/or possibly also product qualities, may be executed in the SCU, DCU, or the server. For instance, since the SCU advantageously is battery operated, the analysis is executed in the DCU or server in order to preserve power consumption and prolong the life time before battery replacement is needed. The frequency of detection that the SCU performs may also be adjusted depending on application and desired power consumption when the SCU is battery operated.

Figure 10:
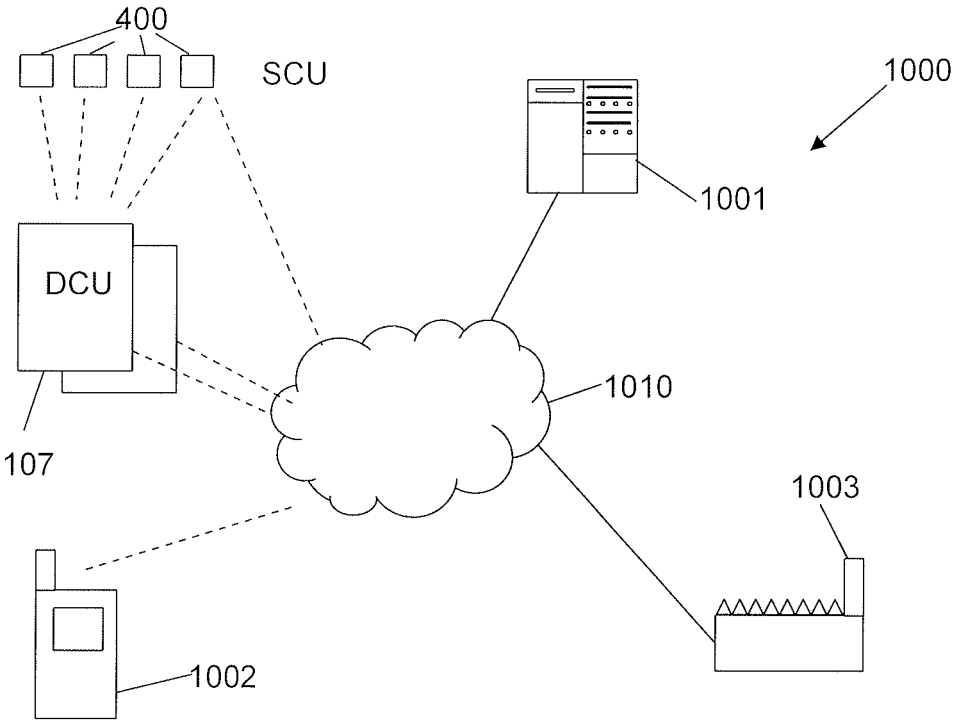
FIG. 10 is a schematic illustration of a system according to the present invention.

The data is transmitted to a server 1001 as illustrated in FIG. 10 showing a system according to the present invention. The system comprises at least one SCU 400, at least one optional DCU 107, and the server 1001. Each SCU transmits wirelessly a signal indicating the current level in a respective dispenser to a DCU 107 or directly to the server 1001 as discussed earlier. A plurality of DCUs may be attached to the system and each DCU is in turn arranged to transmit received signals, either in received form or in analyzed form depending on configuration of the system, upstream to a server using a communication network 1010; advantageously the DCU communicates wirelessly with the communication network which in turn relays the communication data to the server. The server 1001 may be arranged to execute a number of different operations depending on configuration of the system, such as analysis of SCU or DCU signals for determining current level in each dispenser, identify product quality, identify each SCU and corresponding dispenser together with geographical location, keeping track of an inventory, generating reports, transmitting a signal, e.g. a text message, to a user equipment 1002 issued to the janitor for indicating refill of dispenser at a location, and even order products from a distributor 1003 if products availability is getting low at the inventory. The janitor receiving the signal may act upon this and depending on the need for refill, he/she can make a note to refill during next service round or to immediately react and urgently refill the dispenser at the location. The user equipment 1002 may be any suitable device able to communicate with the server directly or indirectly, such as a mobile phone, personal digital assistant (PDA), smart phone, pager, tablet computer, laptop, computer in janitor office area, and so on.

The server may serve several locations of a customer and even several different customers. Customers may be for instance a cleaning company handling in turn one or several clients, office locations which handle their own cleaning or maintenance of washrooms, or organization such as schools, retirement homes, hospitals, and similar organizations providing locations with public or semi public washrooms.

The network 1010 may be any suitable network that may transmit data from the DCU to the server, including but not limited to 4G, 3G, GSM, GPRS, UMTS, LTE, IP based network, Ethernet, the Internet, or similar packet data enabled network solutions directly or in a combination of some of these solutions.

The operation of a central server and real time tracking of use of tissue products open up new revenue streams by providing new business cases, such as keeping track of statistics of use for tissue suppliers enabling more efficient manufacturing and distribution, decreasing service intervals of washrooms, more optimal scheduling of service personnel at different locations, decreasing stocks of tissue products, and so on.

It should be noted that the word "comprising" does not exclude the presence of other elements or steps than those listed and the words "a" or "an" preceding an element do not exclude the presence of a plurality of such elements. It should further be noted that any reference signs do not limit the scope of the claims, that the invention may be at least in part implemented by means of both hardware and software, and that several "means" or "units" may be represented by the same item of hardware.

The above mentioned and described embodiments are only given as examples and should not be limiting to the present invention. Other solutions, uses, objectives, and functions within the scope of the invention as exemplified in the below described embodiments should be apparent for the person skilled in the art.

ABBREVIATIONS

GSM Global System for Mobile Communications
GPRS General Packet Radio Services
EDGE Enhanced Data Rates for GSM Evolution
UMTS Universal Mobile Telecommunications System
LTE Long Term Evolution
WCDMA Wideband Code Division Multiple Access
CDMA2000 Code Division Multiple Access 2000
HSDPA High Speed Downlink Packet Access
SCU Sensor Collection Unit
DCU Data Collection Unit
IP Internet Protocol

The invention claimed is:

1. A tissue dispensing system, comprising:

a tissue holder arranged to receive a tissue product to be dispensed from the tissue holder, the tissue holder comprising at least one sensor collection unit arranged on the tissue holder, the at least one sensor collection unit comprising:

at least one sensor collection processing unit, at least one communication interface, at least two sensor elements, each of the two sensor elements comprising a light source and a light detector and the two sensor elements being separated a distance from each other in at least one direction relative to the tissue product, each of the at least two sensor elements is arranged to periodically transmit light from the light source and detect light reflected from the light source by the light detector, and wherein the at least one sensor collection processing unit is configured to emit signals comprising information relative to a level of remaining tissue product, wherein sensing intervals at which the at least two sensor elements transmit light is adjustable, and wherein the communication interface is triggered to communicate results upon a predetermined level of the tissue product being reached; and a data collection unit comprising at least one data collection processing unit and a communication unit configured to receive the signals from the at least one sensor collection unit; and a third processing unit configured to receive and analyze data from the communication unit and determine a level of the tissue product in the tissue holder; and wherein the data collection unit is arranged to communicate information to the third processing unit for analysis and level determination.

2. The tissue dispenser according to claim 1, wherein the signals are determined based on two separated reflection fields on the tissue product.

3. The tissue dispenser according to claim 1, wherein the light detector comprises a photo detector or a light emitting diode operating in reverse mode.

4. The tissue dispenser according to claim 1, wherein the light detector is arranged to provide a signal relative to a reflectivity level of an area of the tissue product.

5. The tissue dispenser according to claim 1, further comprising a tissue refill provided with a reflectivity level of an area of the tissue product so as to provide a reflection reference.

6. The tissue dispenser according to claim 5, wherein the reflection reference provides information about at least one of a level on the tissue refill, a type of tissue product, and a quality of tissue product.

7. The tissue dispenser according to claim 5, wherein the tissue refill comprises at least one reflection field.

8. A tissue dispensing system, comprising:

a tissue holder arranged to receive a tissue product to be dispensed from the tissue holder, the tissue holder comprising at least one sensor collection unit arranged on the tissue holder, the at least one sensor collection unit comprising:

at least one sensor collection processing unit, at least one communication interface, at least two sensor elements, each of the two sensor elements comprising a light source and a light detector and the two sensor elements being separated a distance from each other in at least one direction relative to the tissue product, each of the at least two sensor elements is arranged to periodically transmit light from the light source and detect light reflected from the light source by the light detector, and wherein the at least one sensor collection processing unit is configured to emit signals comprising information relative to a level of remaining tissue product, and wherein a sensing interval at which the at least two sensor elements transmit light is adjustable, and wherein the communication interface communicates results of the at least two sensor elements;

a data collection unit comprising at least one data collection processing unit and a communication unit configured to receive the signals from the at least one sensor collection unit; and a third processing unit configured to receive and analyze data from the communication unit and determine a level of the tissue product in the tissue holder; and wherein the data collection unit is arranged to communicate information to the third processing unit for analysis and level determination.

9. The tissue dispenser according to claim 8, wherein the signals are determined based on two separated reflection fields on the tissue product.

10. The tissue dispenser according to claim 8, wherein the light detector comprises a photo detector or a light emitting diode operating in reverse mode.

11. The tissue dispenser according to claim 8, wherein the light detector is arranged to provide a signal relative to a reflectivity level of an area of the tissue product.

12. The tissue dispenser according to claim 8, further comprising a tissue refill provided with a reflectivity level of an area of the tissue product so as to provide a reflection reference.

13. The tissue dispenser according to claim 12, wherein the reflection reference provides information about at least one of a level on the tissue refill, a type of tissue product, and a quality of tissue product.

14. The tissue dispenser according to claim 12, wherein the tissue refill comprises at least one reflection field.

15. A tissue dispensing system, comprising:

a tissue holder arranged to receive a tissue product to be dispensed from the tissue holder, the tissue holder comprising at least one sensor collection unit arranged on the tissue holder, the at least one sensor collection unit comprising:

at least one sensor collection processing unit, at least one communication interface, at least two sensor elements, each of the two sensor elements comprising a light source and a light detector and the two sensor elements being separated a distance from each other in at least one direction relative to the tissue product, each of the at least two sensor elements is arranged to periodically transmit light from the light source and detect light reflected from the light source by the light detector, and wherein the at least one sensor collection processing unit is configured to emit signals comprising information relative to a level of remaining tissue product, and wherein the communication interface is triggered to communicate results upon a predetermined level of the tissue product being reached;

a data collection unit comprising at least one data collection processing unit and a communication unit configured to receive the signals from the at least one sensor collection unit; and a third processing unit configured to receive and analyze data from the communication unit and determine a level of the tissue product in the tissue holder; and wherein the data collection unit is arranged to communicate information to the third processing unit for analysis and level determination.

16. The tissue dispenser according to claim 15, wherein the signals are determined based on two separated reflection fields on the tissue product.

17. The tissue dispenser according to claim 15, wherein the light detector comprises a photo detector or a light emitting diode operating in reverse mode.

18. The tissue dispenser according to claim 15, wherein the light detector is arranged to provide a signal relative to a reflectivity level of an area of the tissue product.

19. The tissue dispenser according to claim 15, further comprising a tissue refill provided with a reflectivity level of an area of the tissue product so as to provide a reflection reference.

20. The tissue dispenser according to claim 19, wherein the reflection reference provides information about at least one of a level on the tissue refill, a type of tissue product, and a quality of tissue product.

21. The tissue dispenser according to claim 19, wherein the tissue refill comprises at least one reflection field.

* * * * *